US008302650B2

(12) United States Patent
Gambini

(10) Patent No.: US 8,302,650 B2
(45) Date of Patent: Nov. 6, 2012

(54) DEVICE FOR GLUING THE FINAL EDGE OF A LOG OF A BAND-SHAPED MATERIAL

(75) Inventor: Giovanni Gambini, Pisa (IT)

(73) Assignee: Gambini International S.A., Luxembourg (LU)

( * ) Notice: Subject to any disclaimer, the term of this patent is extended or adjusted under 35 U.S.C. 154(b) by 1 day.

(21) Appl. No.: 13/106,018

(22) Filed: May 12, 2011

(65) Prior Publication Data

US 2011/0277938 A1 Nov. 17, 2011

(30) Foreign Application Priority Data

May 13, 2010 (IT) ..... MI2010A0855

(51) Int. Cl.
*B05C 1/02* (2006.01)

(52) U.S. Cl. ..... 156/446; 156/164; 427/356; 427/358; 427/207.1; 427/428.14; 118/262; 118/264; 118/249; 118/676; 118/209; 118/208; 242/532.3; 242/520; 242/548.3

(58) Field of Classification Search ..... 156/446, 156/184, 504; 427/8, 428.14, 207.1, 358, 427/356; 118/249, 676, 208, 209, 230, 50; 242/532.3, 520, 548
See application file for complete search history.

(56) References Cited

U.S. PATENT DOCUMENTS

| | | | | |
|---|---|---|---|---|
| 5,681,421 | A * | 10/1997 | Biagiotti | 156/446 |
| 6,682,623 | B1 | 1/2004 | Biagiotti | |
| 7,335,263 | B2 * | 2/2008 | Gambini | 118/120 |
| 2007/0246595 | A1 | 10/2007 | Tsai | |

FOREIGN PATENT DOCUMENTS

| | | |
|---|---|---|
| EP | 0481929 A1 | 4/1992 |
| EP | 0699168 A1 | 3/1996 |
| EP | 2096060 A2 | 9/2009 |
| EP | 2149529 A2 | 2/2010 |

OTHER PUBLICATIONS

The Search Report issued by the European Patent Office for corresponding Italian patent application No. MI2010A000881 filed on May 13, 2010; Jan. 12, 2011.

* cited by examiner

*Primary Examiner* — Jeff Aftergut
*Assistant Examiner* — Jaeyun Lee
(74) *Attorney, Agent, or Firm* — Lucas & Mercanti, LLP

(57) ABSTRACT

The present invention refers to a device (1) for gluing the final edge (4*a*) of a log of band-shaped material (4), comprising a rolling plane (2) for feeding a log (3) that has at least a through opening (7) for the application of a glue (8) on the log (3) itself. The device comprises a blade (9) provided for the application of the glue (8) on the log (3). The application blade (9) is mobile between a first position, in which it is spaced from the opening (7), and a second position, in which it is disposed close to the through opening (7). The device (1) comprises a pressure container (10) for housing the glue (8) to be fed to the blade (9). The container (10) has a slot (12) facing towards, and close to an application edge (9*a*) of the blade (9) when the latter is in the first position. The slot (12) defines an expulsion direction of the glue (8), transversal to the handling direction (DM) of the blade (9) so that the glue (8) being expelled deposits on the application edge (9*a*) according to a predefined quantity.

10 Claims, 3 Drawing Sheets

DEVICE FOR GLUING THE FINAL EDGE OF A LOG OF A BAND-SHAPED MATERIAL

CROSS-REFERENCE TO RELATED APPLICATIONS

This Application claims the benefit of priority from Italian Patent Application No. MI2010A 000855 filed on May 13, 2010, the contents of which are incorporated herein by reference.

FIELD OF THE INVENTION

The present invention refers to a device for gluing the final edge of a log of a band-shaped material.

BACKGROUND OF THE INVENTION

The object of the present invention lends itself to being used in the industrial field of machines and devices intended for making logs of tissue paper, like for example toilet paper, kitchen roll and/or similar.

In particular, the present invention concerns a device intended for gluing the final edge of logs of band-shaped material that must be structurally stabilised before carrying out the subsequent cutting step necessary for the formation of the end product.

As known, there are various gluing devices suitable for applying onto the outer surface of the logs being produced, along a direction parallel to the longitudinal axis thereof, a layer or film of glue able to fix the final edge of the band of paper supported, according to a stable position.

Generally, once the glue has been applied to the surface of the log being produced, the log and/or the final edge thereof are suitably manipulated to determine the adhesion of the final edge on the outer surface of the log provided with the glue previously applied, so that the final edge of the band of paper stays glued to the rest of the band supported and the log is ready for the subsequent cutting or punching step.

An example of the aforementioned devices for gluing the final edges of logs of paper is described and illustrated in document EP0481929.

In particular, the described device foresees a rolling plane on which the logs of paper being fed roll in the direction of the next work station. The rolling plane has a through opening through which a predefined quantity of glue is applied on the outer surface of the band of paper supported to ensure that the latter and its final edge are joined together.

The application of the glue is made possible by at least one tubular-shaped container communicating, through a series of holes, with a wedge-shaped upper space, the inclined walls of which define a slot disposed at the through opening of the rolling plane.

The container is connected to suitable means for inserting the glue that determine the overflowing of the latter through the slot of the wedge-shaped space, at the through opening of the rolling plane to engage the outer surface of the band carried by the log being fed.

Under the tubular container there is a collecting space for recovering the excess glue that falls during the production cycle of the logs.

According to a further example of the aforementioned devices for gluing the final edges of logs, described and depicted in document EP0699168, the application of the glue on the logs being fed is carried out through a mobile application blade that immerses, first of all, in the glue and then applies it to the outer surface of the supported band.

In particular, such a system also foresees a rolling plane intended to support the logs being fed. The rolling plane is provided with a through opening through which the aforementioned application blade is able to deposit a predefined quantity of glue on the outer surface of the band carried by the log being fed.

Under the through opening a housing container of the glue is defined that is continuously kept in a filled state.

The application blade is mobile, along a handling direction transversal to the rolling plane, between a first position, in which the application blade is entirely immersed in the glue contained in the housing container and a second position, in which at least one application edge of the application blade surfaces from the glue contained inside the housing container to be located at the through opening of the rolling plane.

The application blade is mobile by means of a suitable linkage that lies inside the housing container completely immersed in the respective glue.

A further device for gluing the final edge of logs is also known, which foresees the use of a fixed application blade on the application edge of which a predefined quantity of glue suitably picked up by a mechanical collecting member is deposited.

In detail, the mechanical collecting member is mobile between a first position in which it immerses into a glue that is housed in a corresponding container, and a second position, in which it is at a higher level with respect to the application edge of the fixed application blade. In such a position, the mechanical collecting member, by gravity, deposits the glue collected earlier on the application edge of the fixed application blade, said glue being prepared for the application step. Thereafter, the collecting member is taken back into the first position to collect the glue and free the rolling plane so that the log being fed can intercept the fixed application blade provided with the glue.

Although known devices for gluing the final edges of the logs of paper allow the stable adhesion of the final edge of the log to the outer surface of the respective band, the Applicant has found that they do nevertheless have some drawbacks and can be improved in various ways, mainly in relation to: the application speed of the glue, in other words the number of logs able to be processed by the devices per minute; the simplicity, practicality and speed of execution of the maintenance operations of the devices; the time and cost of the maintenance operations; the amount of glue used for the application operations of the glue on the logs being fed; as well as the manufacturing and/or marketing costs of the logs of paper produced.

In particular, the Applicant has found that known devices, during the application of the glue, have rather long processing times that have a considerable impact on the production and/or marketing costs of the logs produced.

This drawback can be observed, both in the vertical overflow and in the quoted mechanical application systems, which are limited, during the application of the glue, by its own structural configuration.

Specifically, the vertical overflow application system is subject to the slow introduction of the glue into the application container, by the insertion means.

With regard to the application system by immersion of the application blade, it is inevitably required to move it inside the glue, the density of which significantly opposes the movements of the application blade and of the linkage associated with it with the consequent slowing down of the application operation of the glue.

Similarly to the application system by immersion of the application blade, the system based on a mobile collecting member that immerses into the glue to deposit it onto a fixed application blade is also subject to the resistance of the glue itself.

It should also be considered that such a system is further slowed down by the depositing step, by gravity, of the glue previously collected, on the fixed application blade. Such an operation noticeably penalises the application operation of the glue in terms of processing time, since it requires waiting for the glue itself to fall from the mechanical collecting member to the fixed application blade.

It should also be considered that the maintenance of the mechanical systems for applying the glue is particularly laborious, requiring long time periods to carry it out that have an impact upon the manufacturing and/or marketing costs of the products. Specifically, since the mechanical application systems operate immersed in the glue, they require frequent and meticulous maintenance interventions aimed at ensuring its correct operation.

The maintenance of such members also requires considerable stopping times of the respective machine or production line. Indeed, carrying out such maintenance operations requires, first of all, the complete emptying of the housing container of the glue to make it accessible to workers and, then, the cleaning of the mechanical members involved that move the application blade.

In addition, the application devices quoted above require the presence of considerable masses of glue, both for the feeding of the containers in the vertical overflow systems, and for the immersion of the application blade or of the collecting member, in mechanical movement systems.

In addition, the presence of considerable masses of glue requires frequent maintenance interventions aimed at cleaning the spaces and the ducts dedicated to them, as well as the provision of particularly efficient systems for recovering and filtering the glue, intended to filter the glue that, coming into contact with the mobile mechanical members of the application blade, can become polluted and dirty.

SUMMARY OF THE INVENTION

The main purpose of the present invention is to provide a device for gluing the final edge of a log of a band-shaped material, capable of overcoming the problems encounter in the prior art.

A further purpose of the present invention is to propose a device capable of speeding up the application operation of the glue on the logs being fed.

Another purpose of the present invention is to propose a device capable of processing a large number of logs of paper per minute.

Another purpose of the present invention is to provide a device that is easy and fast to maintain.

A purpose of the present invention is to cut the maintenance costs of the device.

A further purpose of the present invention is to reduce the overall masses of glue in use during the functioning of the device.

Another purpose of the present invention is to simplify the systems for recovering, filtering and recirculating the excess glue collected during the functioning of the device.

The purposes specified above, and others still, are substantially accomplished by a device for gluing the final edge of a log of a band-shaped material, as expressed and described in the following claims.

BRIEF DESCRIPTION OF THE DRAWINGS

As an example, will now be given a description of a preferred but not exclusive embodiment of a device for gluing the final edge of a log of a band-shaped material, in accordance with the present invention. Such a description will be made hereafter with reference to the attached drawings, provided only for indicating purposes and therefore not limiting, in which.

DETAILED DESCRIPTION OF THE INVENTION

Figure 1:
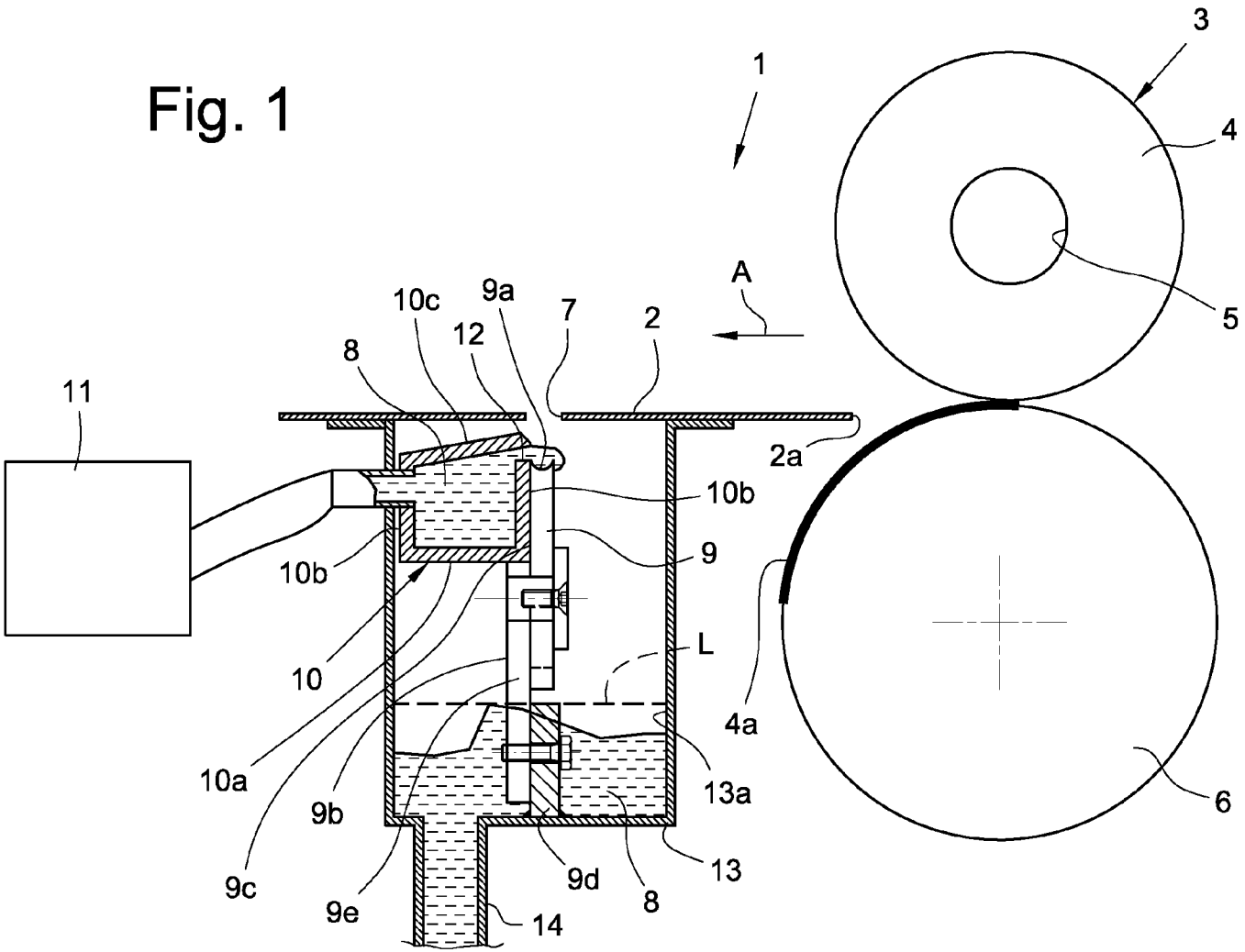
FIG. 1 is a schematic representation in section of a device for gluing the final edge of a log of a band-shaped material depicted in a first significant condition.

With reference to the attached figures, reference numeral 1 wholly indicates a device for gluing the final edge of a log of a band-shaped material, in accordance with the present invention.

As can be seen in the attached figures, the device 1 comprises at least one rolling plane 2 for supporting and rolling at least a log 3 of band-shaped material 4, preferably paper, toilet paper, kitchen roll and/or similar, suitably wound on a support core 5.

As can be seen in the attached figures, each log 3 of band-shaped material 4 is advantageously fed on the rolling plane 2 with the help of at least one known suction roller 6, which is arranged to hold an end edge 4*a* of the band-shaped material 4, while the log 3 is made to move forward along a direction of forward movement A substantially parallel to the rolling plane 2, preferably horizontal or slightly inclined.

In detail, the log 3 is fed (FIG. 1) so as to engage, by rolling, the rolling plane 2 (FIG. 2) which has an abutment edge 2*a* arranged to intercept the final edge 4*a* of the band-shaped material 4.

Figure 2:
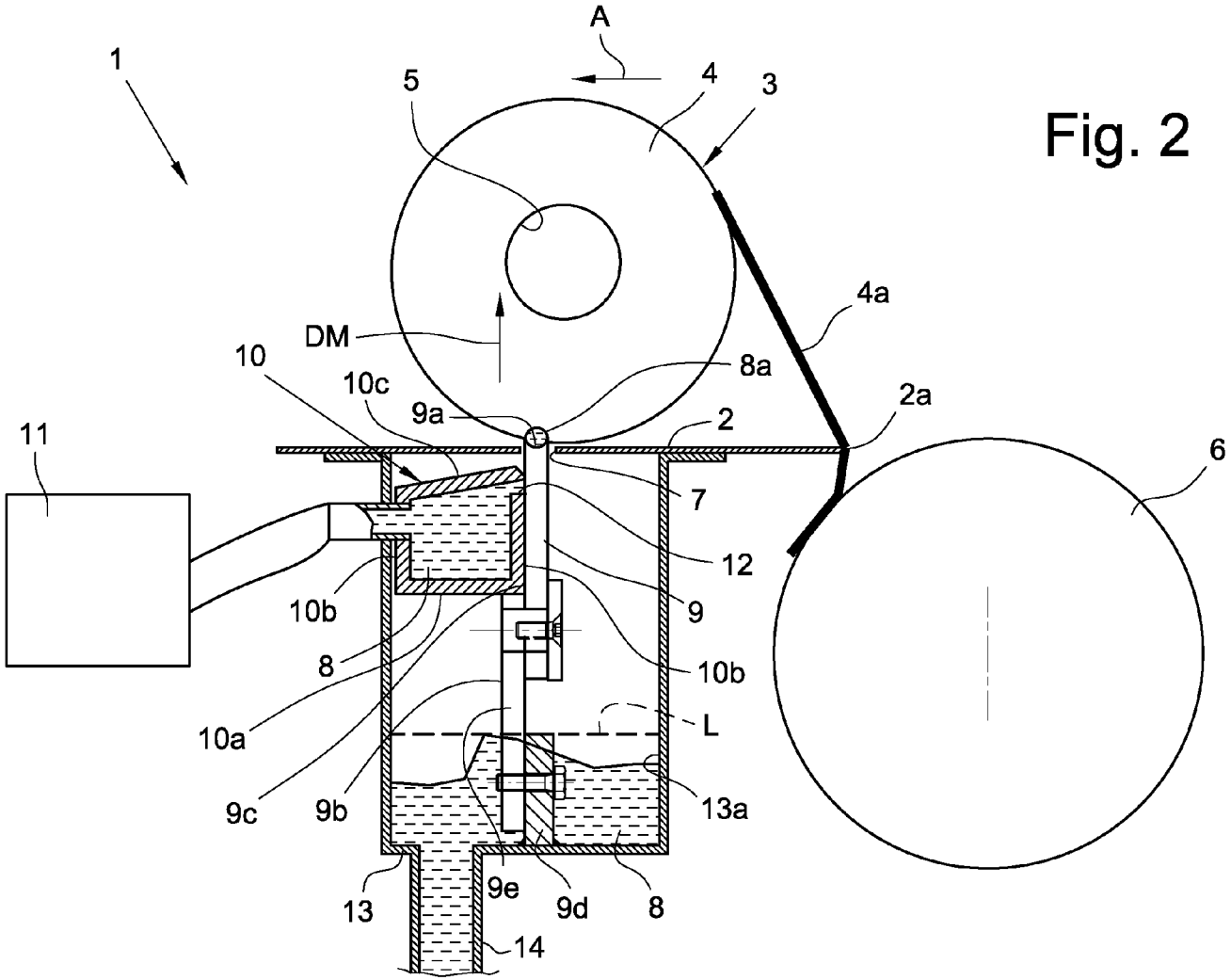
FIG. 2 is a further schematic representation in section of the device according to the previous figure depicted in a second significant condition.
Figure 3:
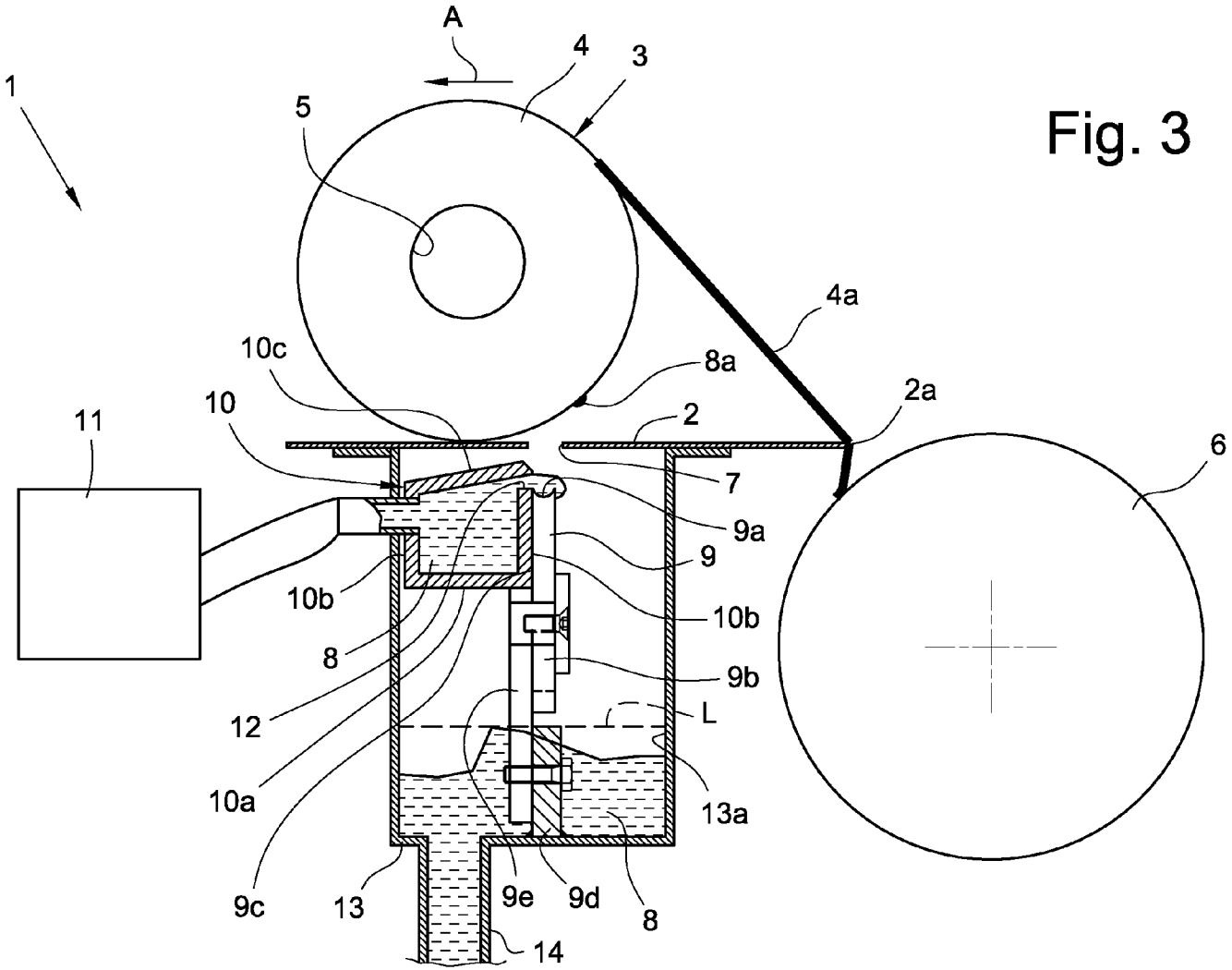
FIG. 3 is another schematic representation in section of the device according to the previous figures depicted in a third significant condition.

As can be seen in FIGS. 2 and 3, during the forward movement of the log 3 along the rolling plane 2, the end edge 4*a* of the band-shaped material 4 is in part put under tension and in part disengaged by the suction roller 6.

Again with reference to the attached figures, the rolling plane 2 has at least a through opening 7 through which the device 1 is able to apply, substantially parallel to the longitudinal extension of the log 3, a predefined quantity of glue 8, on the outer surface of the band-shaped material 4 carried.

In detail, the through opening 7 has an elongated shape and extends transversally, substantially parallel, to the longitudinal extension of the rolling plane 2 and to the direction of forward movement A of the log 3.

In order to apply the glue 8 as quoted above, the device 1 comprises at least one application blade 9 operatively associated with the rolling plane 4. The application blade 9 has at least one application edge 9*a* able to sustain at least one predefined layer 8*a* of glue 8.

The application blade 9 is mobile, along a handling direction DM transversal, preferably perpendicular, to the rolling plane 4, between a first position (FIGS. 1 and 3), in which the application edge 9*a* of the application blade 9 is spaced from the through opening 7, and a second position (FIG. 2), in which the application edge 9*a* of the application blade 9 is disposed close to the through opening 7 of the rolling plane 4.

When the application blade 9 is in the second position (FIG. 2), the rolling of the log 3 along the direction of forward movement A determines the contact between the outer surface of the latter and the application edge 9*a* of the application blade 9, with the consequent transfer of the layer 8*a* of glue from the latter to the log 3.

In detail, the application blade 9 is disposed under the rolling plane 2 for which reason the movement thereof between the first and the second position is carried out along a substantially vertical direction in which the first position corresponds to a lowered position (FIGS. 1 and 3) and the second position corresponds to a raised position (FIG. 2).

The movement of the application blade 9 is ensured by a known linkage 9*b* operatively associated with it, which will be summarily described during the present description.

Again with reference to the attached figures, the device 1 also comprises at least one container 10 for housing the glue 8 to be fed to the application blade 9.

The housing container 10 extends substantially parallel to the through opening 7 according to a substantially elongated shape.

The housing container 10 has a bottom wall 10*a*, preferably horizontal, from which respective side walls 10*b* extend transversally. On the opposite side to the bottom wall 10*a* sits an upper wall 10*c*, preferably inclined with respect to the bottom walls 10*a* and side walls 10*b*.

Again with reference to the attached figures, the housing container 10 is separated from the application blade 9 and it is disposed, preferably below the rolling plane 2, according to a position flanking the latter.

Advantageously, the housing container 10 is pressurised, preferably by means of at least one pump 11 operatively associated with it. The pump 11 is active on the glue 8 to keep the housing container 10 at a pressure value of between two predetermined pressure limit values.

Preferably, the pump 11 acts continuously on the glue 8 to ensure the desired pressure value.

It should nevertheless be noted that the pump 11 can also operate intermittently, preferably when the application blade 9 is in the first position (FIGS. 1 and 3), or else, when it is in transit from the second to the first position.

The housing container 10 preferably has at least one slot 12 which substantially faces towards, and is advantageously located close to, the application edge 9*a* of the application blade 9, when the latter is at least in the first position (FIGS. 1 and 3).

As can be seen in the attached figures, the slot 12 of the housing container 10 is formed through the side wall 10*b* that faces the application blade 9.

Advantageously, the slot 10 is formed at the top of the respective side wall 10*b* of the housing container 10.

As can be seen in FIGS. 1 to 3, the slot 12 defines an expulsion direction of the glue 8, transversal to the handling direction DM of the application blade 9, so that the glue 8 being expelled through the slot 12 deposits on the application edge 9*a* of the application blade 9, according to a predefined quantity, when the latter is located in the first position (FIGS. 1 and 3).

In order to ensure the support of the predefined layer of glue 8 received by the housing container 10, the application edge 9*a* of the application blade 10 has, in cross section, a concave profile facing the through opening 7 of the rolling plane 2, in other words upwards, at least when the application blade 10 is disposed in the first position (FIGS. 1 and 3).

Advantageously, when the application blade 9 is in the first position (FIGS. 1 and 3), the application edge 9*a* is disposed close to, preferably substantially at the same level as, a lower edge of the slot 12, so that the pressurised glue 8, overflows laterally from the housing container 10 to deposit on the application edge 9*a* of the application blade 9.

Again with reference to the attached figures, and in particular to FIG. 2, the application blade 9 has at least one plugging surface 9*c* that faces the side wall 10*b* of the housing container 10 provided with the slot 12. The plugging surface 9*c* is operatively disposed flush with the slot 12 and plugs the latter (FIG. 2) when the application blade 9 is disposed in the second position.

In other words, the plugging surface 9*c* of the application blade 9 laps the side wall 10*b* on which the slot 12 is formed so that the plugging surface 9*c* of the application blade 9 translates along such a side wall 10*b* when the application blade 9 translates between the first (FIGS. 1 and 3) and the second position (FIG. 2).

Again with reference to the attached figures, the device 1 is provided with at least one protection housing 13 that extends, at least partially around the application blade 9 and the housing container 10 to insulate the latter from the surrounding environment.

The protection housing 13 defines, advantageously below the application blade 9 and the housing container 10, at least one collecting space 13*a* of the excess glue 8 that falls during the functioning of the device 1.

The device 1 also comprises at least one recovery and recirculation means (not represented) of the excess glue present in the collecting space 13*a*.

Preferably, the recovery and recirculation means foresees at least one suction pump or similar suction member operatively associated with the protection housing 13 to continuously suck, advantageously through at least one suction duct 14 that extends below the collecting space 13*a*, the glue 8 falling from the application blade 9 and/or from the housing container 10.

Alternatively, the recovery and recirculation means can be activated between a resting condition, in which the glue 8, fallen from the application blade 9 and from the housing container 10, is collected inside the collecting space 13*a*, and an operating condition, in which the glue 8 collected in the collecting space 13*a* is sucked through the aforementioned suction duct 14, to empty the latter.

In this case, the recovery and recirculation means can be switched from the resting condition to the operating condition following the detection of a predetermined level L of glue 8 inside the collecting space 13*a*. Preferably, the predetermined switching level L of the recovery and recirculation means does not exceed the bulk of a support base element 9*d* of the linkage 9*b* of the application blade 9, which is engaged at the bottom of the collecting space 13*a*, as illustrated in the attached figures.

Again with reference to the attached figures, the switching level L of the recovery and recirculation means is advantageously spaced from the application edge 9*a* of the application blade 9.

In detail, the application edge 9*a* is located on the top of the application blade 9, on the opposite side to an intermediate support element 9*e* of the linkage 9*b* that extends below the housing container 10 and engages, on the opposite side with respect to the application blade 9 and the housing container 10, the support base element 9*d*.

In accordance with such an embodiment of a solution, the application edge 9*a* of the application blade 9 is interposed between the rolling plane 2 and the level of the glue 8 present inside the collecting space 13*a*. In this way, the application edge 9*a* of the application blade always stays above the glue 8 collected in the collecting space 13*a*. In other words, both the application blade 9 and most of the linkage 9*b* for moving it, operate without immersing in the glue 8 collected inside the collecting space 13*a*.

The device in accordance with the present invention solves the problems encountered in the prior art and achieves important advantages.

First of all, the device described above allows the application operation of the glue on the logs being fed to be speed up with the consequent processing of a large number of logs per minute, preferably no less than 35 logs per minute.

In addition, the configuration of the device described above particularly facilitates the maintenance operations of the application blade since both the application blade and the linkage for moving it are not immersed in the glue. Consequently, the maintenance interventions can be carried out directly on the application blade or on the movement linkage without requiring either the emptying of the housing container of the glue, which is separate from the application blade, or the emptying of the collecting space.

It should also be considered that the aforementioned configuration of the device substantially reduces the number of maintenance interventions of the application blade and/or of the linkage for moving it, since, as they are separate from the glue being used, they only get dirty to a limited extend due to the glue falling during the lateral overflow from the housing container, as well as from the falling of the glue from the application edge of the application blade.

Of course, the reduction of the maintenance interventions, together with the greater simplicity and speed of the maintenance interventions, allow a significant cutting of the manufacturing and/or marketing costs of the logs of paper produced.

In addition, it should be noted that the particular configuration of the device according to the present invention allows a substantial reduction of the masses of glue necessary for the functioning of the device itself. In particular, the arrangement of a lateral overflow system of the glue from the housing container to the application edge of the application blade allows the management of small amounts of glue with significant advantages in terms of volumes and spaces dedicated to the glue and of components and/or members intended for moving, recovering, recirculating and filtering it.

The invention claimed is:

1. A device for gluing the final edge of a log of a band-shaped material, comprising:

a rolling plane for supporting and rolling at least a log of a band-shaped material, said rolling plane having at least a through opening for the application of a glue on an outer surface of said log; and at least an application blade operatively associated to said rolling plane for the application of said glue on the outer surface of said log, said application blade having at least an application edge able to sustain at least a predefined layer of glue and being moveable, along a handling direction (DM) transversal to said rolling plane, between a first position, in which said application edge of said application blade is spaced from said through opening, and a second position, in which said application edge of said application blade is disposed close to said through opening of said rolling plane, so that the rolling of said log determines the contact between the outer surface of the latter and the application edge of said application blade, wherein it comprises at least a pressure container for housing said glue to be delivered to said application blade, said housing container being separated from said application blade and disposed according to a position substantially flanked with the same, said housing container having at least a slot facing and near to said application edge of said application blade when the latter is in its first position, said slot defining an expulsion direction of said glue, transversal to the handling direction (DM) of said application blade so that said glue, expelled through said slot, settles on said application edge according to a predefined quantity.

2. The device according to claim 1, in which said application edge has, in a cross-section, a concave profile facing said through opening of said rolling plane, at least when said application blade is disposed in the first position, said application edge being disposed, close to, in particular substantially at the same level, of a lower edge of said slot, so that said glue under pressure overflows laterally from said housing container in order to settle onto said application edge of said application blade.

3. The device according to claim 2, in which:

said slot of said housing container is made through a side wall of the latter; and said application blade has at least a plugging surface facing said side wall of said housing container provided with said slot, said plugging surface being operatively disposed flush with said slot and plugging the latter when said application blade is disposed in second position.

4. The device according to claim 3, in which said plugging surface laps the side wall on which said slot is provided, said plugging surface of said application blade translating along said side wall when said application blade translates between the first and second position.

5. The device according to claim 4, in which said housing container is provided with at least a pump acting on said glue in order to maintain said housing container at a pressure value comprised between two predefined pressure values, said pump acting continuously on said glue in order to secure the predefined pressure value.

6. The device according to claim 5, also comprising at least a protection housing extending, at least partially around said application blade and said housing container in order to insulate the latter from the surrounding environment, said protection housing delimiting, below said application blade and said housing container, at least a collecting space of said glue in excess and falling during the functioning of said device.

7. The device according to claim 6, also comprising at least a recovery and recycling means of said glue present in said collecting space, said recovery and recycling means comprising at least a suction pump operatively associated to the protection housing in order to suck continuously, through at least a suction duct which extends below said collecting space, the glue falling from said application blade and/or from said housing container.

8. The device according to claim 6, also comprising at least a recovery and recycling means of said glue present in said collecting space, said recovery and recycling means being actuatable between a resting condition, in which said glue falling from said application blade and/or said housing container, is accumulated within said collecting space and an operating condition, in which said glue accumulated in said collecting space is recovered in order to void the latter, said recovery means can be switched from the resting condition to the operating condition following the detection of a predefined level (L) of the glue, in particular not greater than the dimensions of a support base element of said application blade engaged on the bottom of said collecting space.

9. The device according to claim 8, in which said application edge is disposed at the top of said application blade and opposite to an intermediate support element extending below said housing container, said intermediate support element engaging, opposite to said application blade and housing container said support base element.

10. The device according to claim 9, in which said application edge of said application blade is interposed between said rolling plane and said predefined level (L) of glue in said collecting space, said application edge being able to operate above said predefined level (L) of glue in said collecting space.

* * * * *